US008403692B2

(12) United States Patent
Cao et al.

(10) Patent No.: US 8,403,692 B2
(45) Date of Patent: Mar. 26, 2013

(54) ILLUMINATION DEVICE

(75) Inventors: Qing-Shan Cao, Shenzhen (CN); Yu Hu, Shenzhen (CN); Zheng-Nian Liu, Shenzhen (CN); Miao-Ping Guo, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/301,808

(22) Filed: Nov. 22, 2011

(65) Prior Publication Data

US 2013/0002170 A1 Jan. 3, 2013

(30) Foreign Application Priority Data

Jun. 29, 2011 (CN) ..... 2011 1 0178425

(51) Int. Cl.
*H01R 33/02* (2006.01)

(52) U.S. Cl. ..... 439/226; 362/217.14

(58) Field of Classification Search ..... 439/166, 439/266, 699.2, 816
See application file for complete search history.

(56) References Cited

U.S. PATENT DOCUMENTS

| | | | | |
|---|---|---|---|---|
| 8,193,690 | B2 * | 6/2012 | Wursching et al. | 313/318.1 |
| 2008/0113540 | A1 * | 5/2008 | Miyazono | 439/226 |
| 2011/0157787 | A1 * | 6/2011 | Duan et al. | 361/679.01 |
| 2011/0188238 | A1 * | 8/2011 | Cao et al. | 362/217.14 |
| 2011/0235319 | A1 * | 9/2011 | Fukano et al. | 362/217.14 |
| 2012/0302079 | A1 * | 11/2012 | Sun | 439/226 |
| 2012/0302080 | A1 * | 11/2012 | Sun | 439/226 |

* cited by examiner

*Primary Examiner* — Edwin A. Leon
*Assistant Examiner* — Larisa Tsukerman
(74) *Attorney, Agent, or Firm* — Altis Law Group, Inc.

(57) ABSTRACT

An illumination device includes a light tube holder including two connectors for receiving either a light-emitting diode (LED) tube or a fluorescent tube. One of the connectors includes a rotary member rotatably received in a through hole defined in a retainer, and four conductive elastic pieces positioned in the retainer around the through hole. Two of the conductive pieces are electrically connected to an LED tube drive circuit board and the other two are connected to a fluorescent tube drive circuit board. The rotary member can be rotated to first and second positions, wherein at the first position, the LED tube can be activated, and at the second position the fluorescent tube can be activated.

5 Claims, 19 Drawing Sheets

ILLUMINATION DEVICE

CROSS-REFERENCES TO RELATED APPLICATIONS

Related subject matter is disclosed in co-pending U.S. patent applications with an application Ser. No. 13/301,797 and a title of LIGHT TUBE HOLDER, an application Ser. No. 13/301,799 and a title of ILLUMINATION DEVICE, an application Ser. No. 13/301,800 and a title of ILLUMINATION DEVICE, an application Ser. No. 13/301,801 and a title of ILLUMINATION DEVICE, an application Ser. No. 13/301,805 and a title of ILLUMINATION DEVICE, and an application Ser. No. 13/301,810 and a title of ILLUMINATION DEVICE, which have the same assignees as the current application and were concurrently filed.

BACKGROUND

1. Technical Field

The present disclosure relates to illumination devices, and particularly, to a light-emitting diode (LED) illumination device for adapting an LED tube and a fluorescent tube.

2. Description of the Related Art

Generally, a conventional light tube holder for fluorescent tubes can not be used with LED tubes. When attempting to use an LED tube, the conventional light tube holder needs to be replaced. It is desirable and useful if a light tube holder can adapt to both fluorescent tubes and LED tubes.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
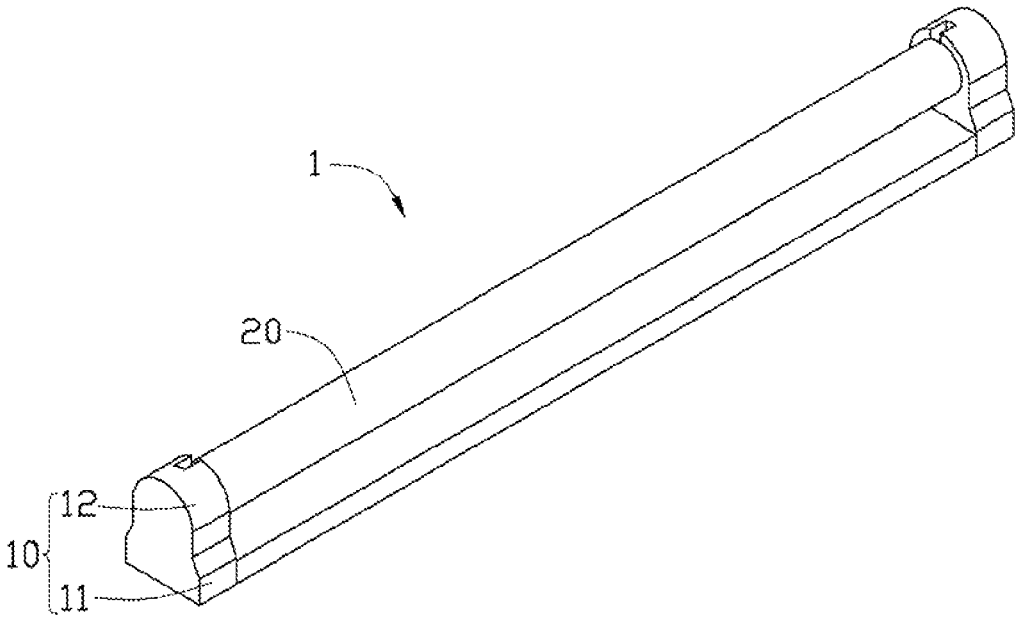
FIG. 1 is an isometric view of an illuminating device in accordance with an exemplary embodiment.
Figure 2:
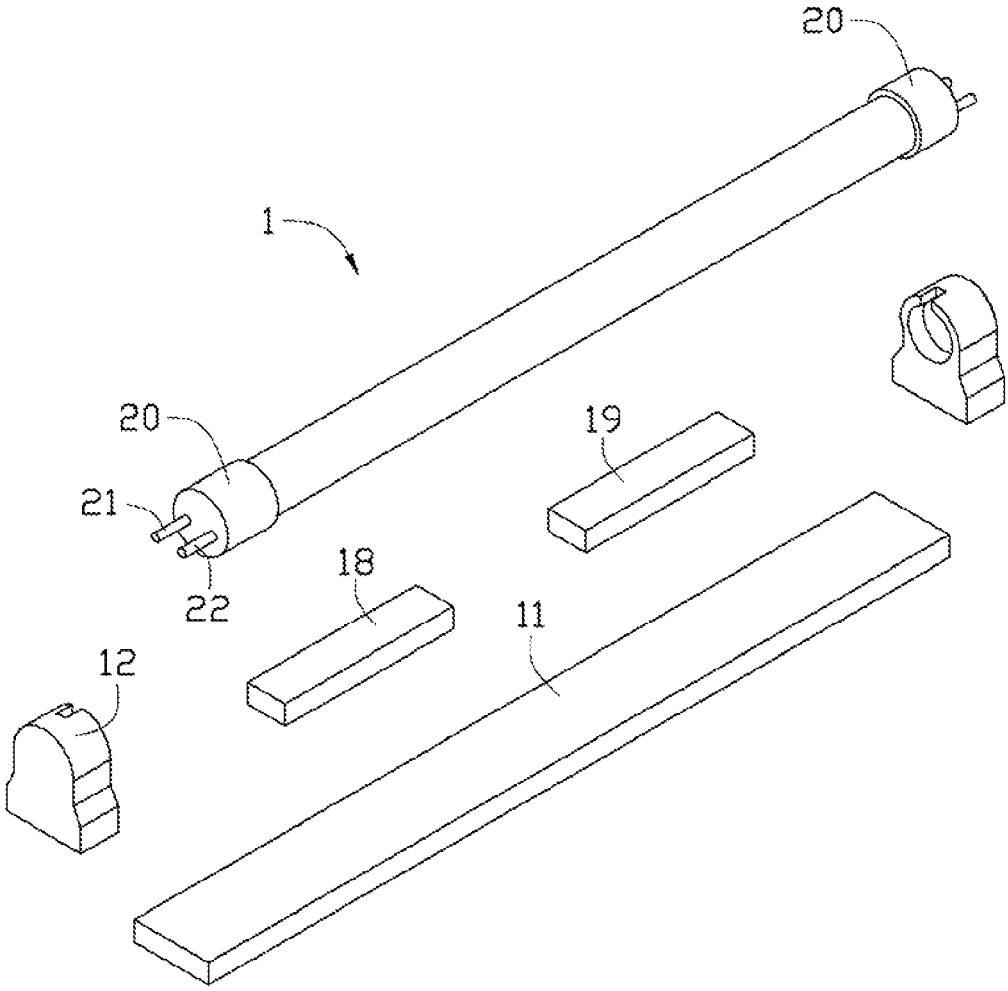
FIG. 2 is an exploded view of the illuminating device in FIG. 1.
Figure 3:
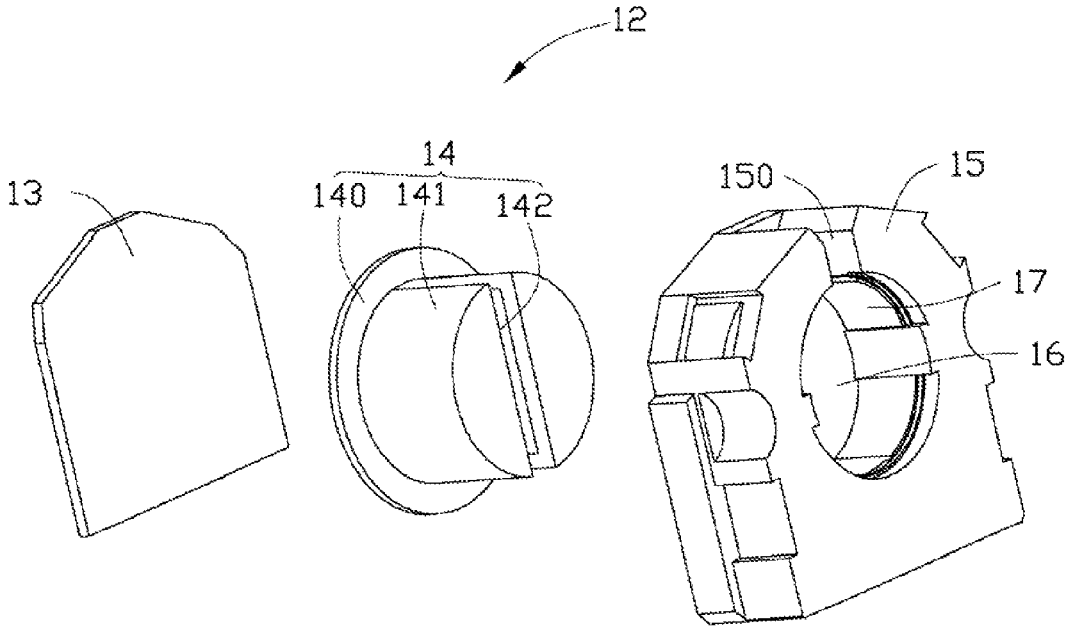
FIG. 3 is an exploded view of a connector of the illuminating device in FIG. 1.

Referring to FIGS. 1-3, an illuminating device 1 includes a tube holder 10 and a tube 20 mounted on the tube holder 10. The tube 20 in FIGS. 1 and 2 is a light-emitting diode (LED) tube 20. A conductive pin 21 and an insulated pin 22 are symmetrically arranged on each end of the LED tube 20. The tube 20 also can be a traditional fluorescent tube which has two conductive pins on one end thereof and two conductive pins on an opposite end thereof.

The tube holder 10 includes a base 11 and two connectors 12 at opposite ends of the base 11. Each connector 12 includes a cap 13, a retainer 15, and a rotary member 14. The cap 13 is attached to one end of the retainer 15. The cap 13 and the retainer 15 cooperatively define a space to receive the rotary member 14 therein. In the embodiment, a through hole 16 is defined in the retainer 15. The rotary member 14 is smaller in diameter than the though hole 16, thereby allowing the rotary member 14 to be received and to rotate in the through hole 16. The rotary member 14 is in the shape of a hat, including a brim 140, a body 141, and a first groove 142. The brim 140 is larger in diameter than the though hole 16, and abuts the outside end face of the retainer 15 around the though hole 16. The first groove 142 is diametrically defined in the body 141 and divides the body 141 into two substantially equal parts. The first groove 142 can receive the two pins of the tube 20 therein. An opening 150 is defined in the retainer 15, on a line substantially perpendicular to, and furthest from, the base 11, and extends from an external surface of the sidewall of the through hole 16, and communicates with the through hole 16.

Figure 4:
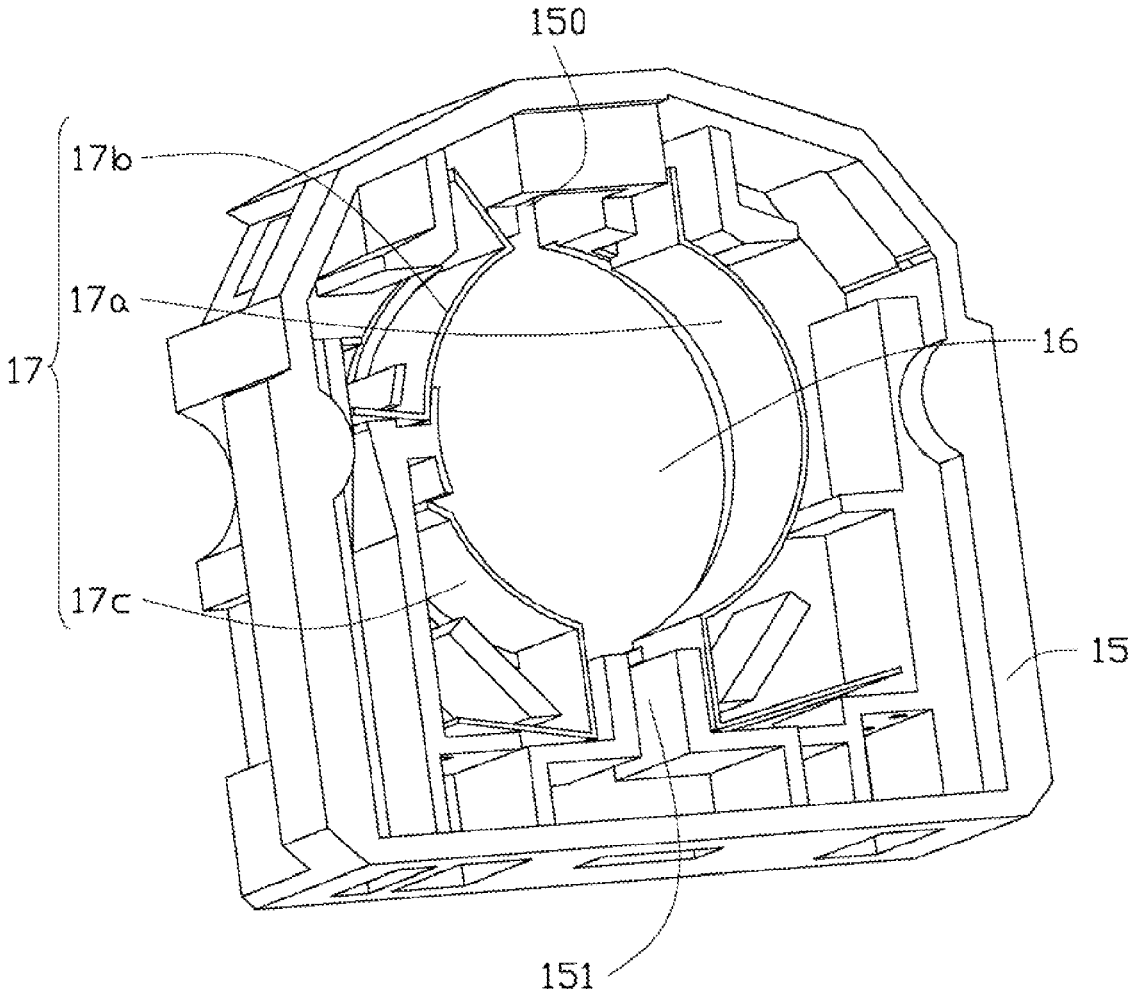
FIG. 4 is an isometric view of a retainer of the connector of the illuminating device in FIG. 3 according to a first exemplary embodiment.

Referring to FIG. 4, an elastic member 17 consisting of three elastic pieces 17*a*, 17*b*, 17*c* is positioned in the retainer 15 around the through hole 16. Each elastic piece 17*a*, 17*b*, 17*c* is made of an elastic metal sheet by stamping. The elastic piece 17*a* has a configuration of a half of a circle, while each of the elastic pieces 17*b*, 17*c* has a configuration of one fourth of a circle. A second groove 151 is defined in the retainer 15 opposite the opening 150. In this embodiment, at least one buffer pad 152 is formed on the side wall between the opening 150 and the second groove 151. The opening 150, the second groove 151, and the at least one buffer pad 152 are used to separate the three elastic pieces 17*a*, 17*b*, 17*c* of the elastic member 17 from each other. The three elastic pieces 17*a*, 17*b*, 17*c* of the elastic member 17 can then be electrically insulated from each other. The tube holder 10 further includes an LED tube drive circuit board 18 and a fluorescent tube drive circuit board 19 mounted in the base 11. The elastic pieces 17*a*, 17*b* are connected to the LED tube drive circuit board 18 and the elastic pieces 17*a*, 17*c* are connected to the fluorescent tube drive circuit board 19.

When installing the tube 20, the rotary member 14 is first rotated to cause the first groove 142 to align with the opening 150. The pins 21 of the tube 20 can then be inserted into the through hole 16 and supported in the first groove 142. The tube 20 can then be rotated to misalign the first groove 142 of the rotary member 14 with the opening 150, and securely retain the tube 20 in the retainer 15.

When the tube 20 is rotated to a predetermined position (indicated by a mark (not shown) on the connector 12), the rotary member 14 is rotated to a first position where the pins 21 of the tube 20 make contact with the elastic pieces 17*a*, 17*b* of the elastic member 17. Thus, the tube 20 can be driven by the LED tube drive circuit board 18. When the element 14 is rotated to a second position, the pins 21 of the tube 20 make contact with the elastic pieces 17*a*, 17*c* of the elastic member 17, allowing the tube 20 to be driven by the fluorescent tube drive circuit board 19. By virtue of these arrangements, the tube holder 10 can well adapt to any type of the tube 20.

In the first embodiment, the elastic member 17 includes three elastic pieces 17*a*, 17*b*, and 17*c*. The length of the elastic piece 17*a* is about 0.5 A, where A represents the perimeter of the through hole 16. The lengths of the elastic pieces 17*b* and 17*c* are both 0.25 A. The number of the at least one buffer pad 152 is one. Thus, the elastic pieces 17*a*, 17*b*, and 17*c* are separated from each other by the opening 150, the second groove 151 and the buffer pad 152.

In an alternative embodiment, the elastic pieces 17*a* and 17*b* may be connected to the fluorescent tube drive circuit board 19, and the elastic pieces 17*a* and 17*c* may be connected to the LED tube drive circuit board 18.

Figure 5:
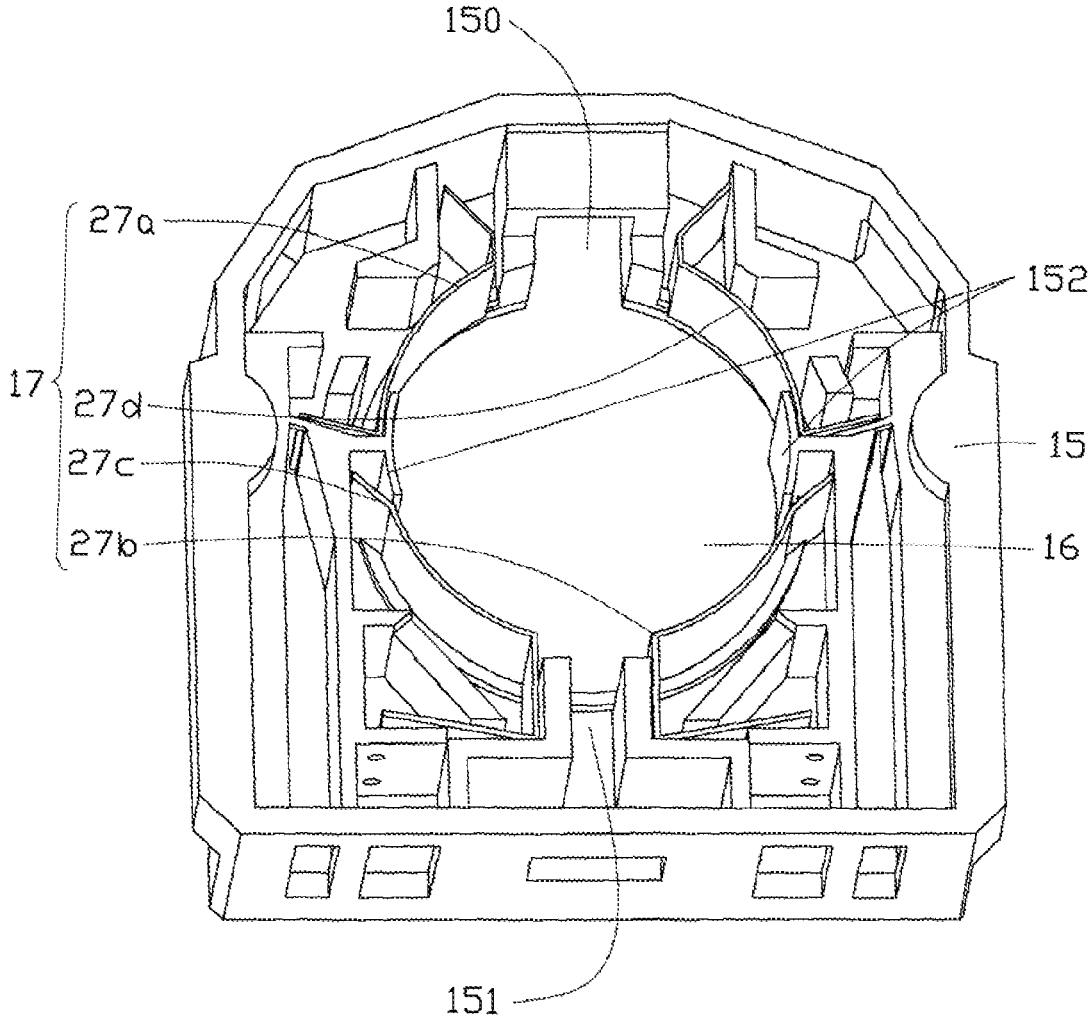
FIG. 5 is an isometric view of the retainer of the connector of the illuminating device in FIG. 3 according to a second exemplary embodiment.

Referring to FIG. 5, in a second embodiment, there are four elastic pieces 27*a*, 27*b*, 27*c*, and 27*d* constituting the elastic member 17. The lengths of the four elastic pieces 27*a*, 27*b*, 27*c*, and 27*d* are all 0.25 A. The number of the at least one buffer pad 152 is two. Thus, the elastic pieces 27*a*, 27*b*, 27*c*, and 27*d* are separated from each other by the opening 150, the second groove 151 and the two buffer pads 152.

In the embodiment, the elastic pieces 27*a* and 27*b* are connected to the LED tube drive circuit board 18, and the elastic pieces 27*c* and 27*d* are connected to the fluorescent tube drive circuit board 19. The first position mentioned above is the position where the pins 21 of the tube 20 stay in contact with the elastic pieces 27*a* and 27*b*, and the second position mentioned above is the position where the pins 21 of the tube 20 stay in contact with the elastic pieces 27*c* and 27*d*.

Figure 6:
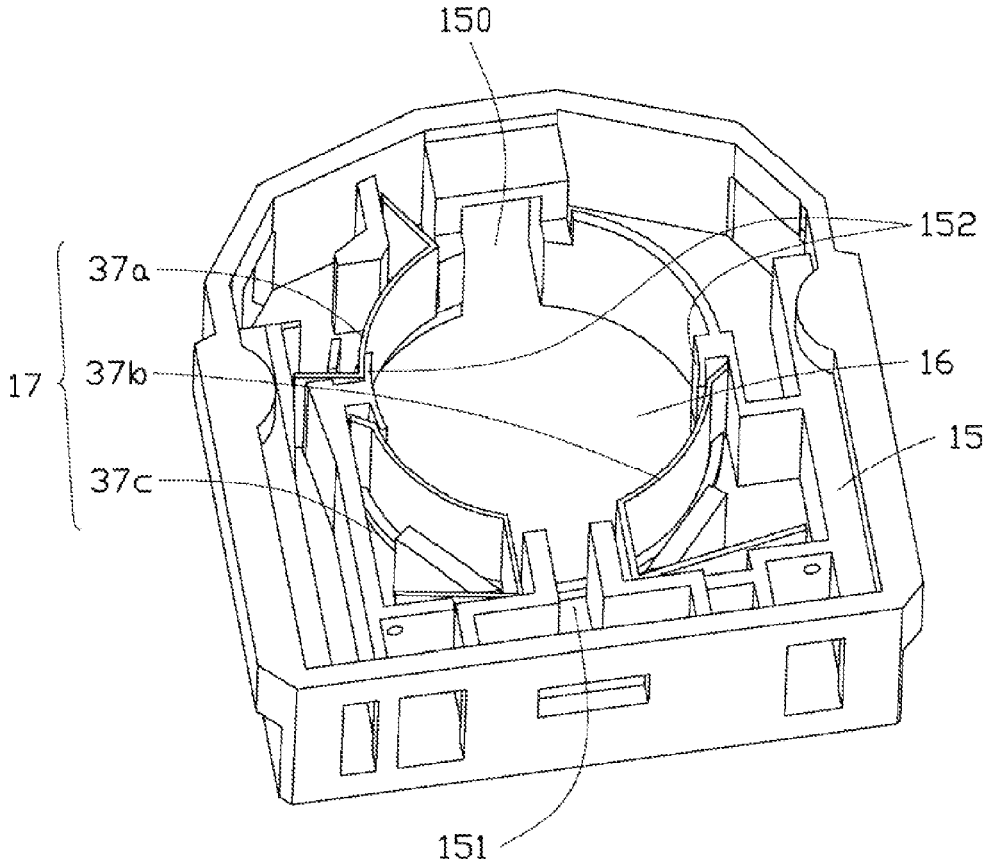
FIG. 6 is an isometric view of the retainer of the connector of the illuminating device in FIG. 3 according to a third exemplary embodiment.

Referring to FIG. 6, in a third embodiment, there are three elastic pieces 37*a*, 37*b* and 37*c* constituting the elastic member 17. The lengths of the three elastic pieces 37*a*, 37*b*, and 37*c* are all 0.25 A. The number of the at least one buffer pad 152 is two. Thus, the elastic pieces 37*a*, 37*b*, and 37*c* are separated from each other by the opening 150, the second groove 151 and the two buffer pads 152.

In the embodiment, the elastic pieces 37*a* and 37*b* are connected to the fluorescent tube drive circuit board 19, and the elastic piece 37*c* is connected to the LED tube drive circuit board 18. The first position mentioned above is the position where the pins 21 of the tube 20 stay in contact with the elastic piece 37*c*, and the second position mentioned above is the position where the pins 21 of the tube 20 stay in contact with the elastic pieces 37*a* and 37*b*.

Figure 7:
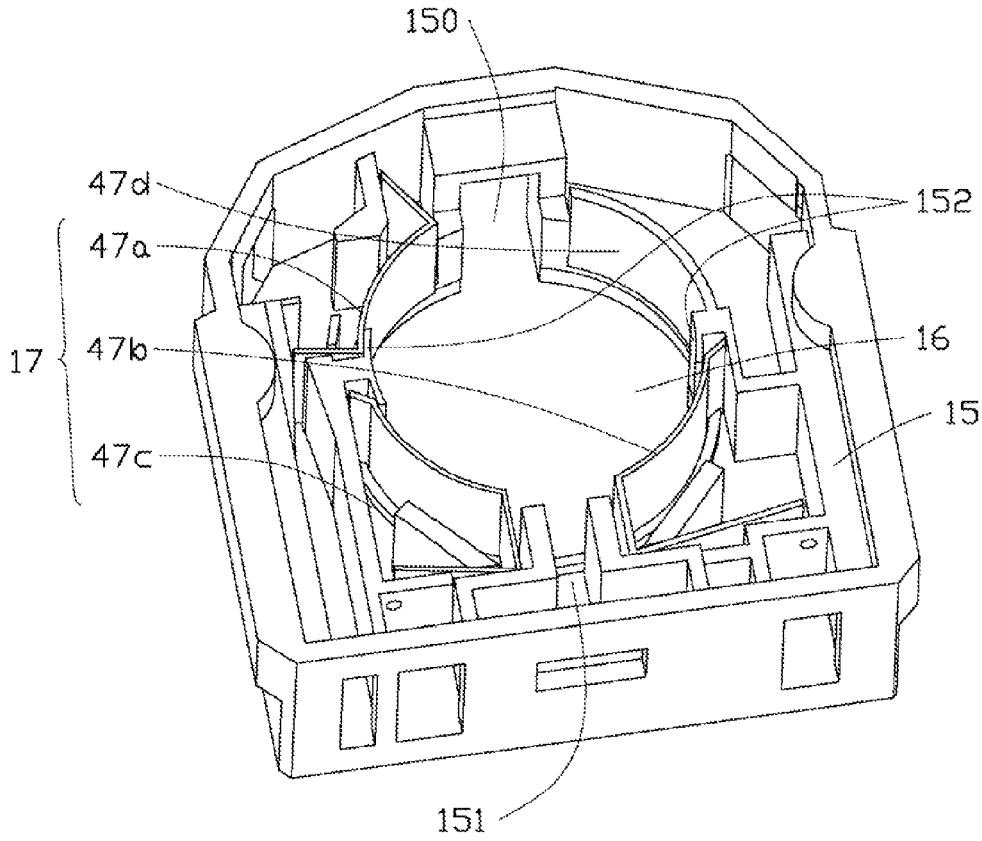
FIG. 7 is an isometric view of the retainer of the connector of the illuminating device in FIG. 3 according to a fourth exemplary embodiment.
Figure 8:
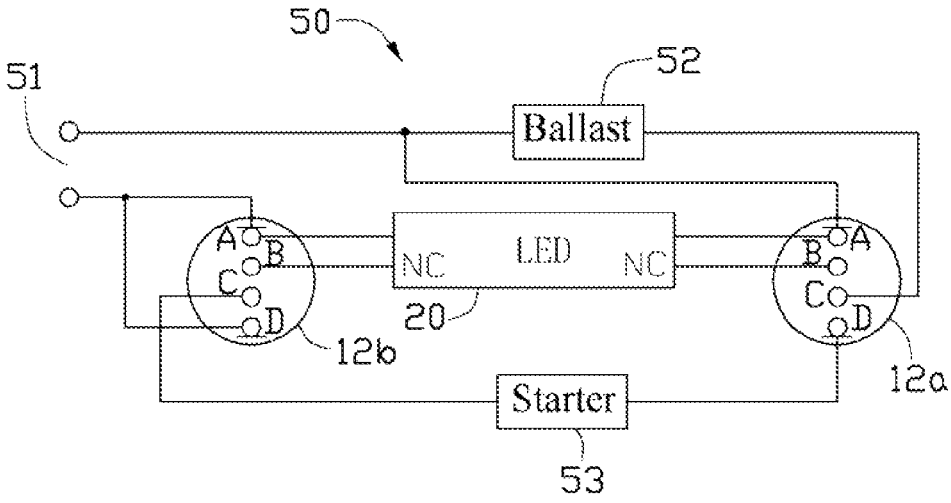
FIG. 8 is a circuit diagram of the illumination device in FIG. 1, illustrating an LED tube connected to the two connectors in FIG. 5 according to a first exemplary embodiment.
Figure 9:
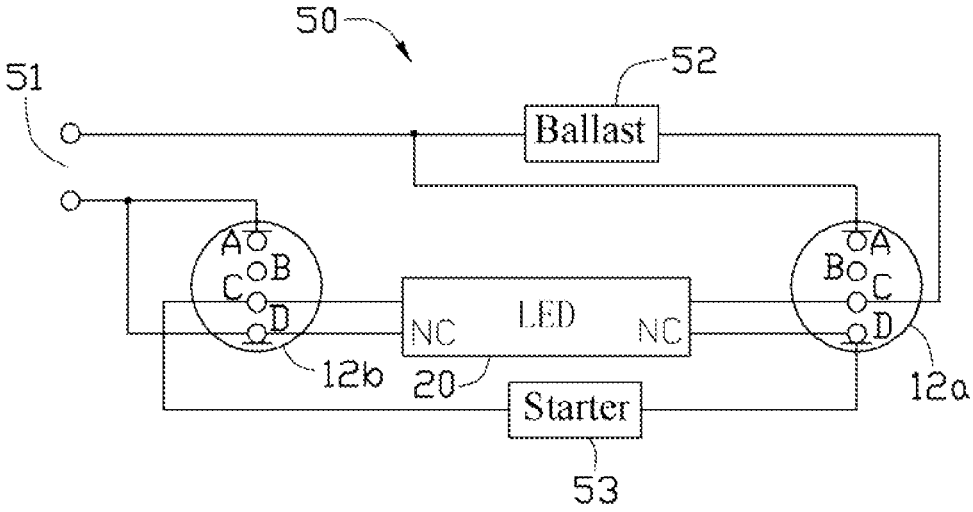
FIG. 9 is a circuit diagram of the illumination device in FIG. 1, illustrating an LED tube connected to the two connectors in FIG. 5 according to a second exemplary embodiment.
Figure 10:
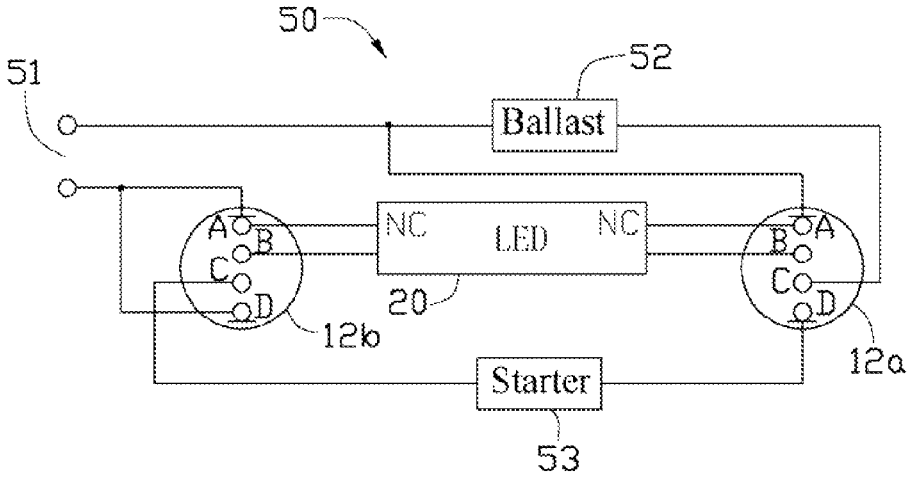
FIG. 10 a circuit diagram of the illumination device in FIG. 1, illustrating an LED tube connected to the two connectors in FIG. 5 according to a third exemplary embodiment.
Figure 11:
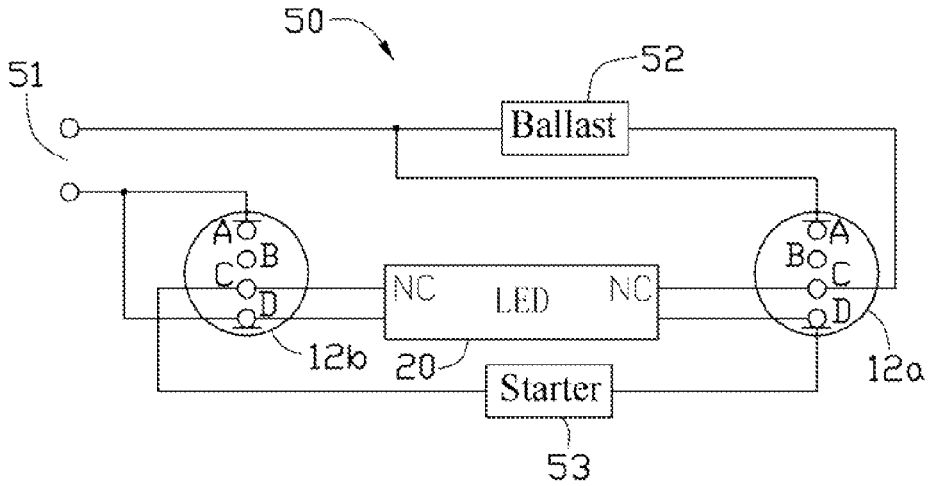
FIG. 11 is a circuit diagram of the illumination device in FIG. 1, illustrating an LED tube connected to the two connectors in FIG. 5 according to a fourth exemplary embodiment.

Referring to FIG. 7, in a fourth embodiment, there are three elastic pieces 47*a*, 47*b*, and 47*c* constituting the elastic member 17. The lengths of the three elastic pieces 47*a*, 47*b*, and 47*c* are all 0.25 A. An insulation piece 47*d* is positioned in the retainer 15 around the through hole 16. The insulation piece 47*d* is resilient and has a configuration of a quarter of a circle. The length of the insulation piece 47*d* is about 0.25 A. The number of the at least one buffer pad 152 is two. Thus, the elastic pieces 47*a*, 47*b*, 47*c*, and the insulation piece 47*d* are separated from each other by the opening 150, the second groove 151 and the two buffer pads 152.

When installing the tube 20, the rotary member 14 is rotated to a position where the pins 21 of the tube 20 stay in contact with the elastic piece 47*c* and the insulation piece 47*d*, the elastic piece 47*c* and the insulation piece 47*d* can tightly press against the two pins 21 of the tube 20, thereby holding the tube 20 in position.

In the embodiment, the elastic pieces 47*a* and 47*b* are connected to the fluorescent tube drive circuit board 19, and the elastic piece 47*c* is connected to the LED tube drive circuit board 18. The first position mentioned above is the position where the pins 21 of the tube 20 stay in contact with the elastic piece 47*c*, and the second position mentioned above is the position where the pins 21 of the tube 20 stay in contact with the elastic pieces 47*a* and 47*b*.

The illumination device 1 may include two connectors 12 of FIG. 4, FIG. 5, FIG. 6, or FIG. 7. Alternatively, the illumination device 1 may include one connector 12 of FIG. 4, and one connector 12 of FIG. 5.

Referring to FIGS. 8-11, in the embodiment, the illumination device 1 includes two connectors 12*a* and 12*b* of FIG. 5. The elastic piece 27*a* of the connector 12*a* is connected to the positive terminal of a power supply 51 and the elastic piece 27*a* of the connector 12*b* is connected to the negative terminal of the power supply 51. The elastic pieces 27*b* of the connector 12*a* and 12*b* are disconnected. A starter 53 is connected between the elastic piece 27*c* of the connector 12*b* and the elastic piece 27*d* of the connector 12*a*. A ballast 52 is connected between the positive terminal of the power supply 51 and the elastic piece 27*c* of the connector 12*a*. The elastic piece 27*c* of the connector 12*a* is connected to the positive terminal of the power supply 51 via a ballast 53. The elastic piece 27*d* of the connector 12*b* is connected to the negative terminal of the power supply 51.

When installing the LED tube 20, the two pairs of pins can be inserted into the though holes 16 of the connectors 12*a* and 12*b*. The LED tube 20 can be rotated, and when the LED tube 20 is rotated to the first position, the two conductive pins 21 make and stay in contact with the elastic piece 27*a* of the connector 12*a* and the elastic piece 27*a* of the connector 12*b*, and the two insulated pins 22 make and stay in contact with the elastic piece 27*b* of the connector 12*a* and the elastic piece 27*b* of the connector 12*b*, thus allowing the two conductive pins 21 of the LED tube 20 to be connected to the positive and negative terminals of the power supply 51. The ballast 52 and starter 53 are disconnected from the LED tube drive circuit board 18. Thus, the LED tube 20 can be driven by the LED drive circuit board 18 (shown in FIG. 8).

When the LED tube 20 is rotated to a position to make the two conductive pins 21 stay in contact with the elastic piece 27*c* of the connector 12*a* and the elastic piece 27*c* of the connector 12*b*, and the two insulated pins 22 stay in contact with the elastic piece 27*d* of the connector 12*a* and the elastic piece 27*d* of the connector 12*b*, this causes one conductive pin 21 of the LED tube 20 to be connected to the positive terminal of the power supply 51 via the ballast 52. Thus, the LED tube 20 cannot be driven by the LED drive circuit board 18 (shown in FIG. 9).

When the LED tube 20 is rotated to a position to make the two conductive pins 21 stay in contact with the elastic piece 27*b* of the connector 12*a* and the elastic piece 27*b* of the connector 12*b*, and the two insulated pins 22 stay in contact with the elastic piece 27*a* of the connector 12*a* and the elastic piece 27*a* of the connector 12*b*, this causes the two insulated pins 22 of the LED tube 20 to be connected to the positive and negative terminals of the power supply 15. Thus, the LED tube 20 cannot be driven by the LED drive circuit board 18 (shown in FIG. 10).

When the LED tube 20 is rotated to a position to make the two conductive pins 21 stay in contact with the elastic piece 27*d* of the connector 12*a* and the elastic piece 27*d* of the connector 12*b*, and the two insulated pins 22 stay in contact with the elastic piece 27*c* of the connector 12*a* and the elastic piece 27*c* of the connector 12*b*, this causes the one insulated pin 22 of the LED tube 20 to be connected to the positive terminal of the power supply 51 via the ballast 52. The starter 53 is connected between one insulated pin 22 and one conductive pin 21 of the LED tube 20. Thus, the LED tube 20 cannot be driven by the LED drive circuit board 18 (shown in FIG. 11).

Figure 12:
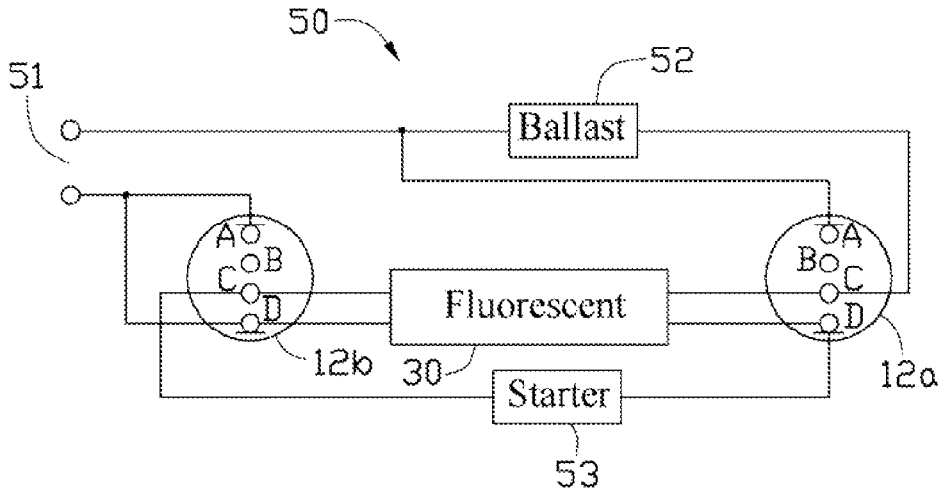
FIG. 12 is a circuit diagram of the illumination device in FIG. 1, illustrating a fluorescent tube connected to the two connectors in FIG. 5 according to a first exemplary embodiment.
Figure 13:
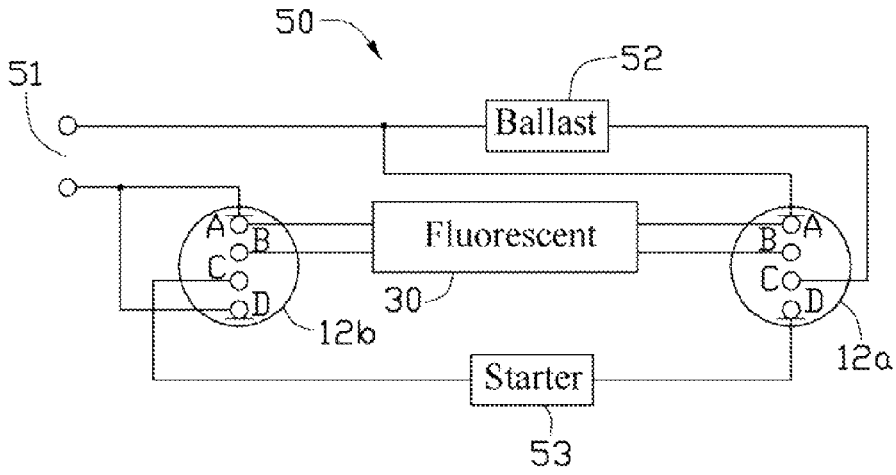
FIG. 13 is a circuit diagram of the illumination device in FIG. 1, illustrating a fluorescent tube connected to the two connectors in FIG. 5 according to a second exemplary embodiment.

Referring to FIGS. 12 and 13, when installing a fluorescent tube 30, the two pairs of pins can be respectively inserted into the through holes 16 of the connectors 12*a* and 12*b*. The fluorescent tube 30 can be rotated, and when the fluorescent tube 30 is rotated to the second position, the pins of the fluorescent tube 30 make and stay in contact with the elastic pieces 27*c* and 27*d* of the connectors 12*a* and the elastic pieces 27*c* and 27*d* of the connector 12*b*, thus allowing the two pins of the fluorescent tube 30 to be connected to the positive and negative terminals of the power supply 51. The starter 53 is connected between the two pins of the fluorescent tube 30, and the ballast 52 is connected between the power supply 51 and the fluorescent tube 30. Thus, the fluorescent tube 30 can be driven by the fluorescent drive circuit board 19 (shown in FIG. 12).

When the fluorescent tube 30 is rotated to a position whereby the two pairs of pins make and stay in contact with the elastic pieces 27*a* and 27*b* of the connectors 12*a* and the elastic pieces 27*a* and 27*b* of the connector 12*b*, this causes the starter 53 and the ballast 52 are disconnected from the fluorescent tube 30, and then the fluorescent tube 30 cannot be driven by the fluorescent drive circuit board 19 (shown in FIG. 13).

Figure 14:
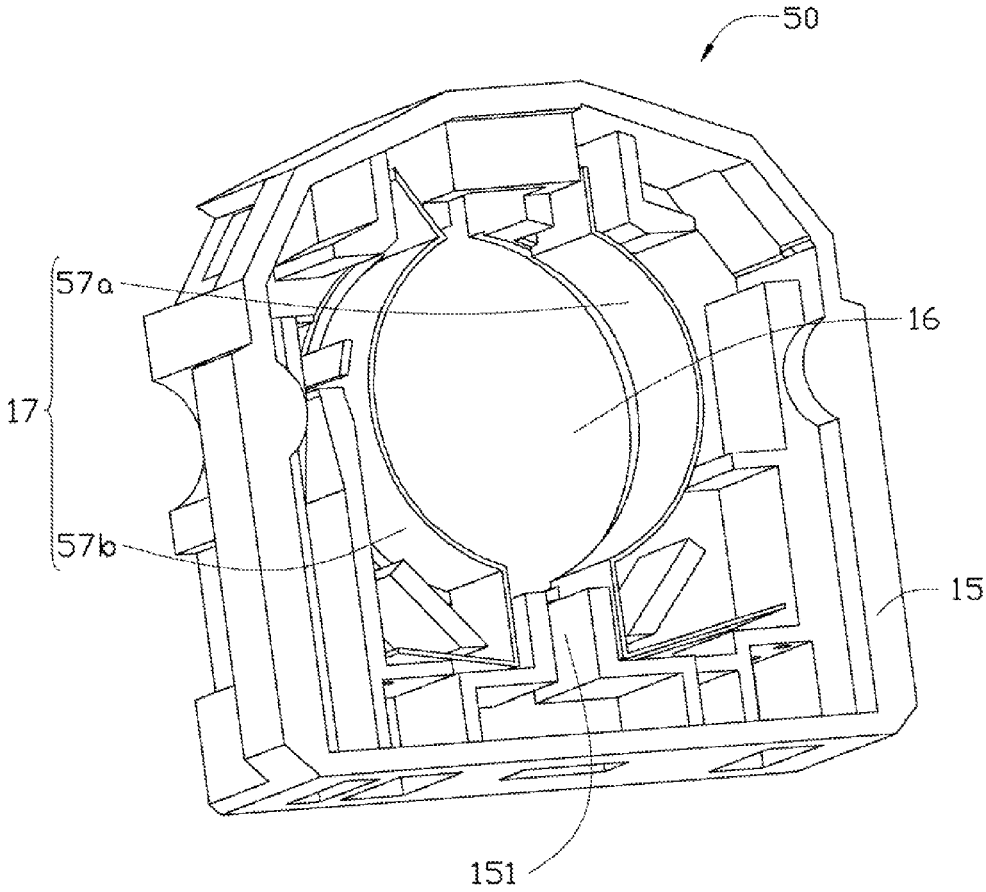
FIG. 14 is an isometric view of a retainer of a connector for a conventional fluorescent tube.

FIG. 14 illustrates a connector 50 for the fluorescent tube 20. Two elastic pieces 57*a* and 57*b* constituting an elastic member 17 are arranged around the through hole 16 in the connector 50, and the lengths of the elastic pieces 57*a* and 57*b* are 0.5 A. The elastic pieces 57*a* and 57*b* are separated from each other by the opening 150 and the second groove 151. The elastic pieces 57*a* and 57*b* are connected to the fluorescent tube drive circuit board 19.

The illumination device 1 may include the one connector 12 of FIG. 4 or FIG. 5 and one connector 50 of FIG. 14.

Figure 15:
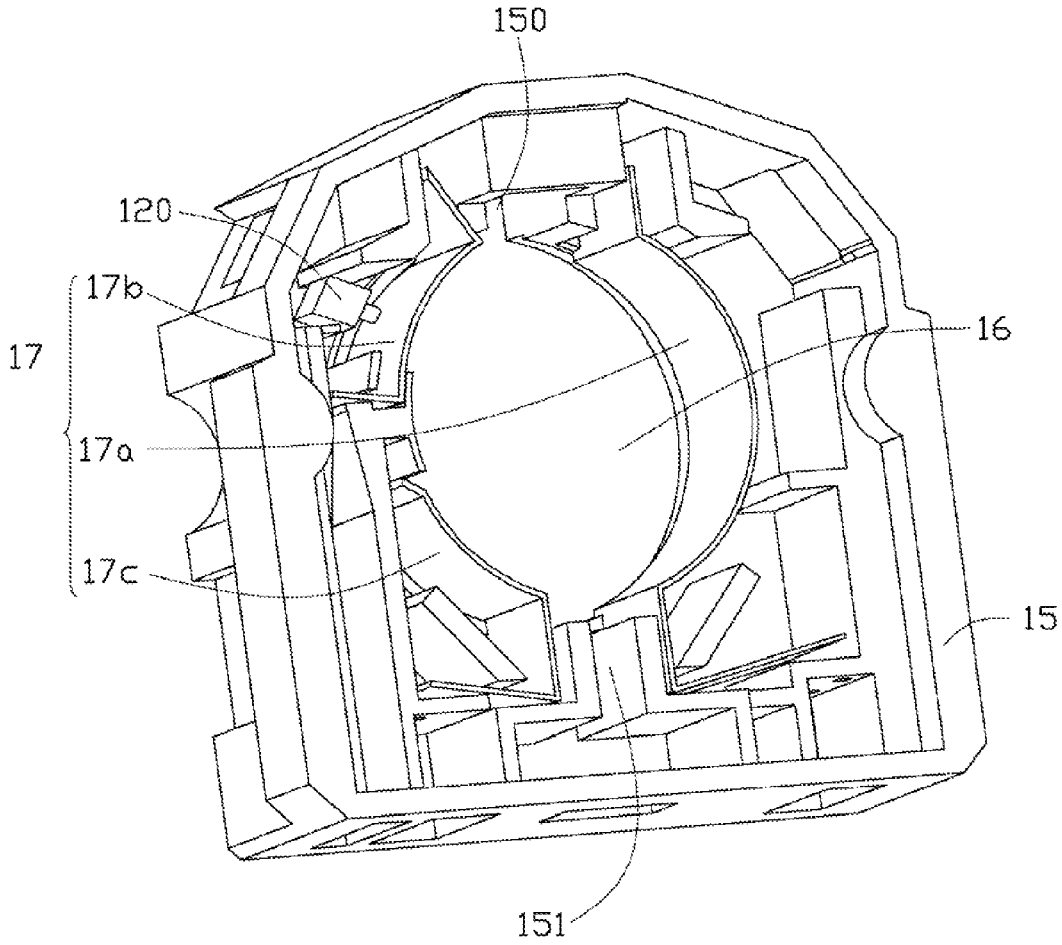
FIG. 15 is an isometric view of the retainer of the connector of the illuminating device in FIG. 3 according to a fifth exemplary embodiment.
Figure 16:
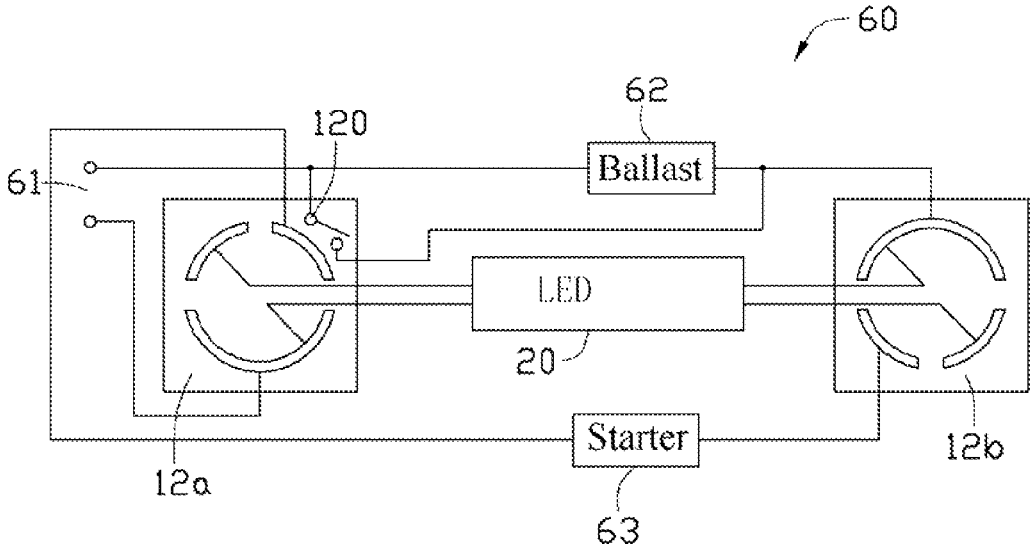
FIG. 16 is a circuit diagram of the LED illumination device in FIG. 1 with two connectors in FIG. 15 in accordance with an exemplary embodiment.

Referring to FIG. 15, the connector 12 further includes a switch 120 positioned between the edge of the retainer 15 and the elastic pieces 17*b* which connected to the LED drive circuit board 18. FIG. 16 illustrates a drive circuit of the illumination device 1 with two connectors 12 of FIG. 4 and the LED tube 20 connected thereto. The elastic piece 17*a* is connected to a negative terminal of the power supply 61. One end of the switch 120 and one end of a ballast 62 are connected to a positive terminal of the power supply 61, and the other end of the switch 120 is connected to the other end of the ballast 62, then connected to the elastic piece 17*a* of the connector 12*b*. A starter 63 is connected between the elastic piece 17*b* of the connector 12*a* and the elastic piece 17*c* of the connector 17*b*. Thus, when the switch 120 is closed, the ballast 53 is shorted.

When the tube 20 is rotated to a predetermined position (indicated by a mark on the connector 12), the rotary member 14 is rotated to a first position where the pins 21 of the tube 20 make and stay in contact with the elastic pieces 17*a*, 17*b* of the elastic member 17. The elastic piece 17*b* contacted with one pin 21 of the tube 20 is pushed to be deformed and actuated the switch 120 to be closed. As a result, the ballast 62 is shorted out, thereby allowing the tube 20 to be driven by the LED tube drive circuit board 18. When the rotary member 14 is rotated to a second position, the pins 21 of the tube 20 make and stay in contact with the elastic pieces 17*a*, 17*c* of the elastic member 17, the elastic piece 17*b* is then released and out of contact with the switch 120. The switch 120 then becomes open, thereby allowing the ballast 62 to be connected between the positive terminal of the power supply 61 and the elastic piece 17*a*. The tube 20 can then be driven by the fluorescent tube drive circuit board 19.

Figure 17:
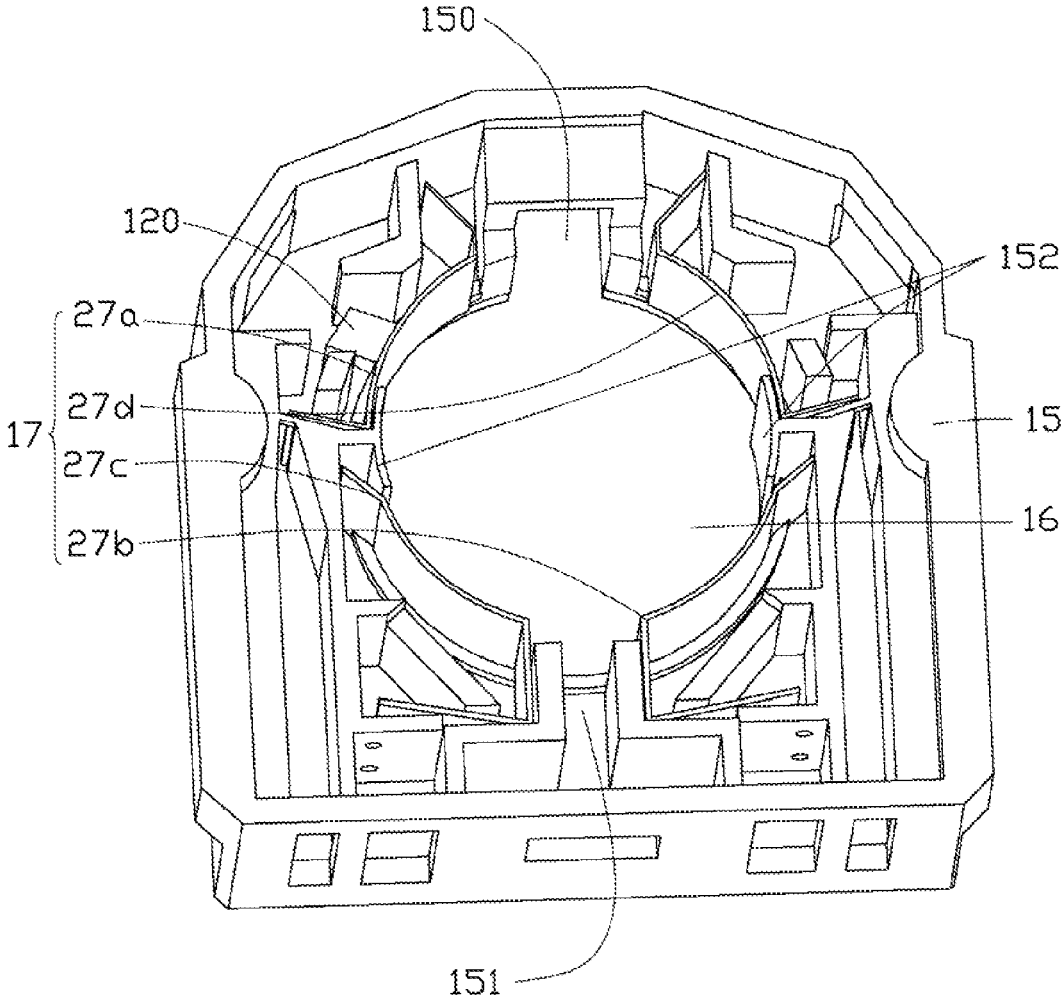
FIG. 17 is an isometric view of the retainer of the connector of the illuminating device in FIG. 3 according to a sixth exemplary embodiment.
Figure 18:
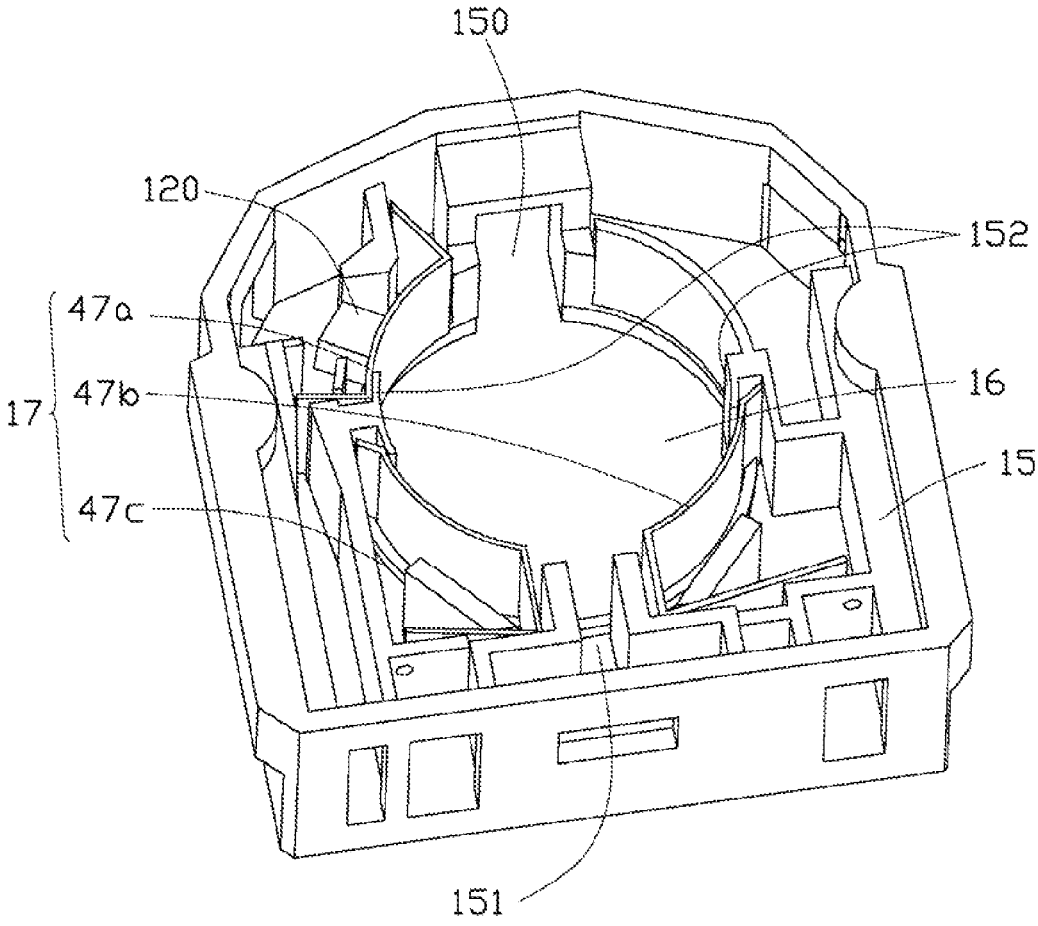
FIG. 18 is an isometric view of the retainer of the connector of the illuminating device in FIG. 3 according to a seventh exemplary embodiment.
Figure 19:
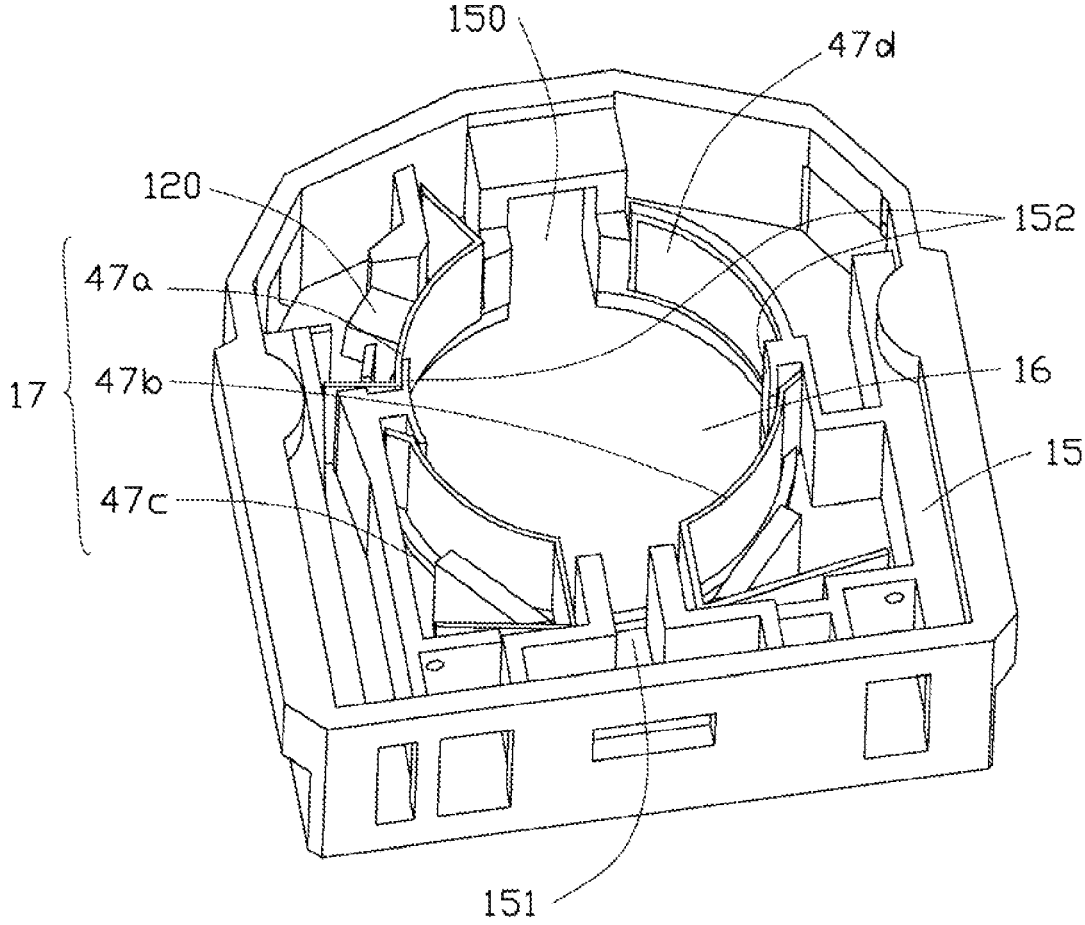
FIG. 19 is an isometric view of the retainer of the connector of the illuminating device in FIG. 3 according to an eighth exemplary embodiment.

Referring to FIGS. 17-19, in a fifth embodiment, the connector 12 having four elastic pieces 27*a*, 27*b*, 27*c*, and 27*d* as shown in FIG. 5 may further include the switch 120 which is positioned next to the elastic piece 27*a*. In a sixth embodiment, the connector 12 having three elastic pieces 37*a*, 37*b*, and 37*c* as shown in FIG. 6 may further include the switch 120 which is positioned next to the elastic piece 37*a*. In an eighth embodiment, the connector 12 having three elastic pieces 47*a*, 47*b*, and 47*c* and the insulation piece 47*d* as shown in FIG. 7 may further include the switch 120 which is positioned next to the elastic piece 47*a*.

Alternatively, the illumination device 1 may include the two connectors 12 as shown in FIG. 15, or may include the two connectors 12 as shown in FIG. 17.

The present disclosure may be embodied in other forms without departing from the spirit thereof. The present examples and embodiments are to be considered in all respects as illustrative and not restrictive, and the disclosure is not to be limited to the details given herein.

What is claimed is:

1. An illumination device comprising:

a light tube holder comprising:

a base;

a drive circuit board mounted in the base and comprising a light-emitting diode (LED) tube drive circuit board, and a fluorescent tube drive circuit board;

first and second connectors arranged at opposite ends of the base for selectively receiving one of a fluorescent tube and an LED tube, the fluorescent tube comprising two conductive pins arranged on one end thereof and another two conductive pins arranged on an opposite end thereof, the LED tube comprising a conductive pin and an insulated pin arranged on each end of the LED tube;

wherein each of the first and second connectors comprising:

a retainer defining a though hole;

a rotary member rotatably received in the through hole, and defining a first groove to receive two pins on one end of one of the tubes; and four elastic pieces positioned in the retainer around the through hole, the four elastic pieces comprising at a first elastic piece, a second elastic piece, a third elastic piece, and a fourth elastic piece, the first and second elastic pieces electrically connecting with the LED tube drive circuit board, and the third and fourth elastic pieces electrically connecting with the fluorescent tube drive circuit board, the first elastic piece of the first connector electrically connecting with a positive terminal of a power supply, the third elastic piece of the first connector electrically connecting with the positive terminal power supply via a ballast, the fourth elastic piece of the first connector electrically connecting with the third elastic piece of the second connector via a starter, and the first and fourth elastic pieces of the second connector electrically connecting with a negative terminal of the power supply;

wherein when the rotary member of the first connector is rotated to a first position, the two pins on the one end of one of the tubes stay in contact with the first and second elastic pieces, and wherein when the one of the tubes is the LED tube, the conductive pin and the insulated pin in one end of the LED tube are respectively connected with the first and second elastic pieces of a corresponding connector, whereby power flows through the conductive pins of the LED tube via the LED tube drive circuit to cause the LED tube to illuminate; and wherein when the rotary member of the first connector is rotated to a second position, the two pins on the one end of one of the tubes stay in contact with the third and fourth elastic pieces of a corresponding connector, respectively, and wherein when the one of the tubes is the fluorescent tube, the fluorescent tube is driven by the fluorescent tube drive circuit board.

2. The illumination device as recited in claim 1, wherein the each of the four elastic pieces has an arced configuration.

3. The illumination device as recited in claim 1, wherein an opening is defined in the retainer of the first connector and extends from an external lateral surface to a sidewall thereof surrounding the through hole, and communicates with the through hole.

4. The illumination device as recited in claim 3, wherein the first connector further comprising:

a second groove defined in the retainer thereof opposite the opening; and two buffer pads formed on the side wall, between the opening and the second groove, wherein the opening, the second groove, and the two buffer pads separate the four elastic pieces from each other.

5. The illumination device as recited in claim 4, wherein a length of each of the first, second, third and fourth elastic pieces is about a quarter of a perimeter of the through hole.

* * * * *